US011262099B2

(12) United States Patent
Park et al.

(10) Patent No.: US 11,262,099 B2
(45) Date of Patent: Mar. 1, 2022

(54) CAP AND WATER-HEATING DEVICE INCLUDING THE SAME

(71) Applicant: KYUNGDONG NAVIEN CO., LTD., Gyeonggi-do (KR)

(72) Inventors: Jun Kyu Park, Seoul (KR); Jeon Hur, Seoul (KR); Hwa Yong Cha, Seoul (KR)

(73) Assignee: KYUNGDONG NAVIEN CO., LTD., Gyeonggi-do (KR)

( * ) Notice: Subject to any disclaimer, the term of this patent is extended or adjusted under 35 U.S.C. 154(b) by 0 days.

(21) Appl. No.: 16/943,047

(22) Filed: Jul. 30, 2020

(65) Prior Publication Data

US 2021/0071908 A1 Mar. 11, 2021

(30) Foreign Application Priority Data

Sep. 11, 2019 (KR) ..... 10-2019-0113103

(51) Int. Cl.

| | |
|---|---|
| ***F24H 1/00*** | (2006.01) |
| ***F24H 9/02*** | (2006.01) |
| ***F24H 9/06*** | (2006.01) |
| ***F23J 13/04*** | (2006.01) |
| ***F23J 13/00*** | (2006.01) |

(52) U.S. Cl.

CPC ..... *F24H 1/0072* (2013.01); *F23J 13/00* (2013.01); *F23J 13/04* (2013.01); *F24H 9/02* (2013.01); *F24H 9/06* (2013.01)

(58) Field of Classification Search

CPC .. F24H 9/06; F24H 9/02; F24H 1/0072; F23J 13/00; F23J 13/04

See application file for complete search history.

(56) References Cited

U.S. PATENT DOCUMENTS

| | | | | |
|---|---|---|---|---|
| 3,091,223 A * | 5/1963 | Vitale | F24H 1/205 122/18.2 |
| 3,659,560 A * | 5/1972 | Carter | F24H 1/18 122/19.2 |
| 5,533,495 A * | 7/1996 | Moore, Jr. | F23L 17/04 122/18.2 |
| 9,903,610 B2 | 2/2018 | Ishikado et al. | |
| 2009/0142720 A1* | 6/2009 | Pussell | F24H 1/205 432/29 |

FOREIGN PATENT DOCUMENTS

| | | |
|---|---|---|
| KR | 20-2010-0010984 U | 8/2011 |
| KR | 10-2016-0133425 A | 11/2016 |
| KR | 10-1927264 B | 12/2018 |
| WO | 2007-030855 A | 3/2007 |

* cited by examiner

*Primary Examiner* — Steven S Anderson, II

(74) *Attorney, Agent, or Firm* — Johnson & Martin, P.A.; James David Johnson

(57) ABSTRACT

The present disclosure provides a cap and a water-heating device having the same. The cap for covering a top side of a case of the water-heating device includes a cover having a receiving space that is open at the bottom, the cover including an exhaust hole formed therein for releasing exhaust gas in the case to the outside, and an exhaust duct that is received in the receiving space and coupled to the cover and that forms an exhaust channel that connects an exhaust tube included in the case and the exhaust hole and releases the exhaust gas, in which the exhaust duct is formed of a material different from a material of the cover, and the material of the exhaust duct has higher heat resistance than the material of the cover.

11 Claims, 7 Drawing Sheets

CAP AND WATER-HEATING DEVICE INCLUDING THE SAME

CROSS-REFERENCE TO RELATED APPLICATION

This application claims the benefit of priority to Korean Patent Application No. 10-2019-0113103, filed in the Korean Intellectual Property Office on Sep. 11, 2019, the entire contents of which are incorporated herein by reference.

TECHNICAL FIELD

The present disclosure relates to a cap and a water-heating device including the same, and more particularly, relates to a cap for allowing an indoor water-heating device to be used outdoors and a water-heating device including the cap.

BACKGROUND

A water-heating device, such as a water heater, a boiler, or the like, may be installed indoors or outdoors depending on an installation environment.

In the related art, an outdoor water-heating device is manufactured to be suitable only for outdoor use, and an indoor water-heating device is manufactured to be suitable only for indoor use. Therefore, in a case where the outdoor water-heating device is installed indoors, it may not be easy to supply air and release exhaust gas, and in a case where the indoor water-heating device is installed outdoors, foreign matter may be introduced through a connecting adaptor installed at the top, an air supply tube, or an exhaust tube, and therefore the indoor water-heating device is more likely to malfunction.

When water-heating devices are separately manufactured for indoor use and outdoor use, it may be inefficient in terms of production and inventory management. Accordingly, a method for installing one product both indoors and outdoors is required.

SUMMARY

The present disclosure has been made to solve the above-mentioned problems occurring in the prior art while advantages achieved by the prior art are maintained intact.

An aspect of the present disclosure provides a cap for allowing one product to be installed both indoors and outdoors by converting an indoor water-heating device such that the indoor water-heating device is installed and used outdoors, and a water-heating device including the cap.

Another aspect of the present disclosure provides a cap for facilitating inventory management by allowing a water-heating device to be converted for indoor or outdoor use depending on an installation environment or a country in which the water-heating device is installed.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a cap for covering a top side of a case of a water-heating device includes a cover having a receiving space that is open at the bottom, the cover including an exhaust hole formed therein for releasing exhaust gas in the case to the outside, and an exhaust duct that is received in the receiving space and coupled to the cover and that forms an exhaust channel that connects an exhaust tube included in the case and the exhaust hole and releases the exhaust gas, in which the exhaust duct is formed of a material different from a material of the cover, and the material of the exhaust duct has higher heat resistance than the material of the cover.

According to another aspect of the present disclosure, a water-heating device includes a case that has an interior space therein and that includes an air supply tube that introduces air into the interior space and an exhaust tube that releases exhaust gas generated in the interior space, and a cap that covers a top side of the case. The cap includes a cover having a receiving space that is open at the bottom, the cover including an exhaust hole formed therein for releasing the exhaust gas in the interior space to the outside, and an exhaust duct that is received in the receiving space and coupled to the cover and that forms an exhaust channel that connects an exhaust tube included in the case and the exhaust hole and releases the exhaust gas, in which the exhaust duct is formed of a material different from a material of the cover, and the material of the exhaust duct has higher heat resistance than the material of the cover.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, exemplary embodiments of the present disclosure will be described in detail with reference to the accompanying drawings.

The following embodiments are embodiments appropriate for an understanding of technical features of a cap and a water-heating device including the same according to the present disclosure. However, the present disclosure is not limited to the following embodiments, and technical features of the present disclosure are not restricted by the following embodiments. Furthermore, various changes and modifications can be made without departing from the spirit and scope of the present disclosure.

Figure 1:
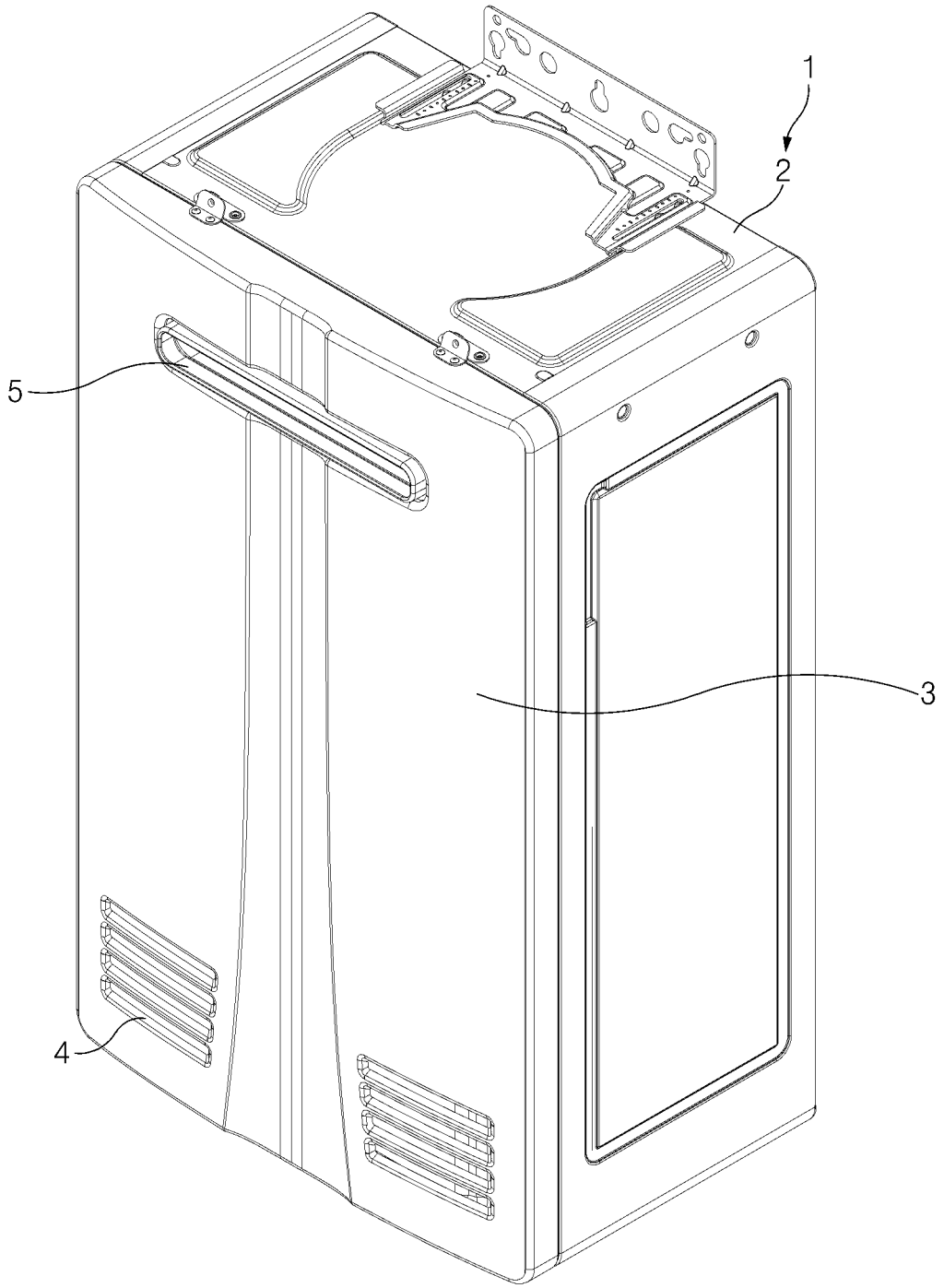
FIG. 1 is a perspective view illustrating an outdoor water-heating device.
Figure 2:
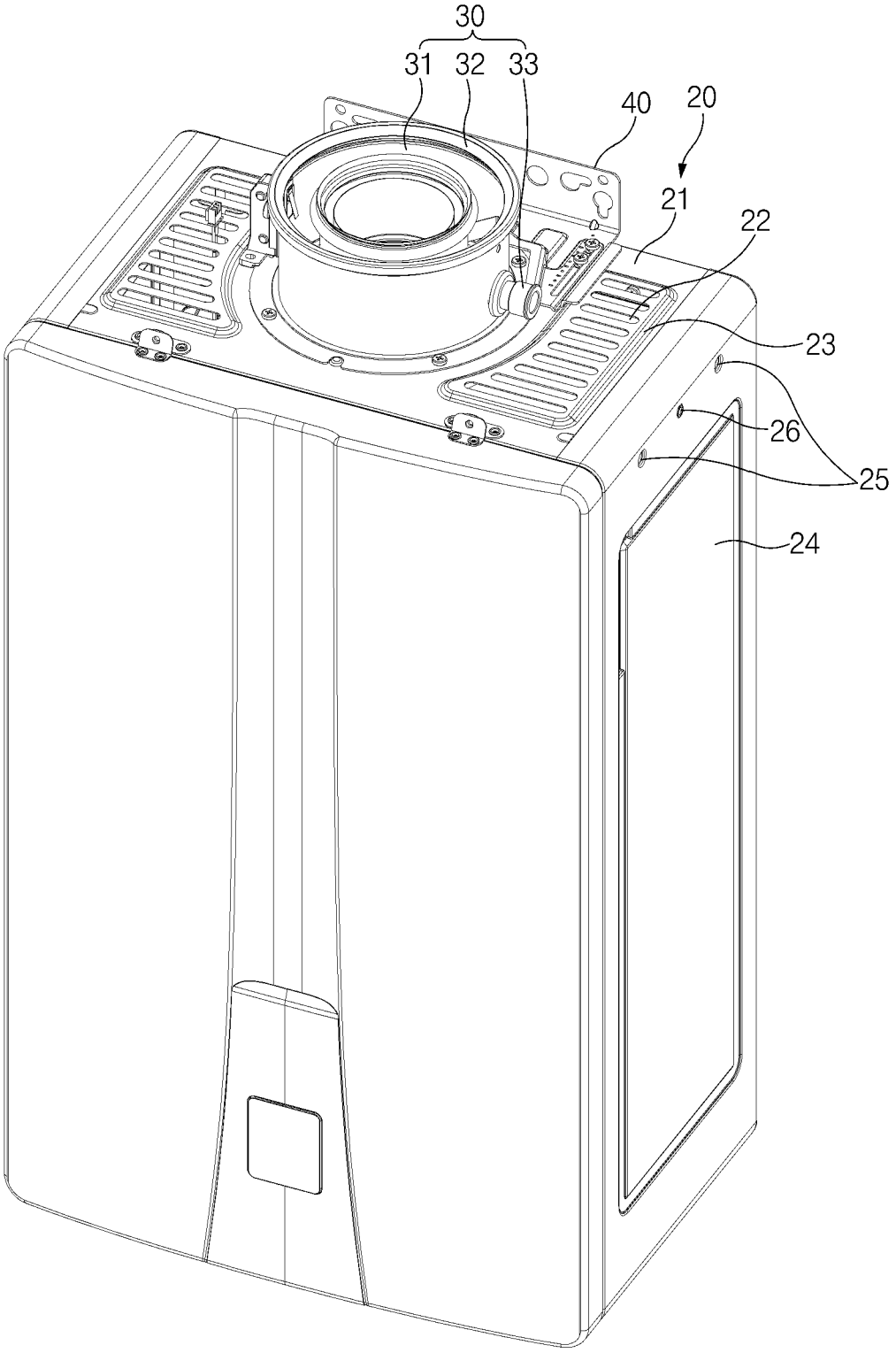
FIG. 2 is a perspective view illustrating an indoor water-heating device.

FIG. 1 illustrates an outdoor water-heating device, and FIG. 2 illustrates an indoor water-heating device.

Referring to FIG. 1, the outdoor water-heating device 1 includes a case having a space formed therein, and the case includes an upper surface 2 and a side surface 3. As the outdoor water-heating device 1 is installed outdoors, air supply holes 4 and an exhaust hole 5 are generally formed in the side surface 3 of the case to prevent introduction of foreign matter such as rainwater into the outdoor water-heating device 1.

Referring to FIG. 2, a case 20 of the indoor water-heating device includes an upper surface 21 and a side surface 24. As the indoor water-heating device is installed indoors, an air supply tube 27 and an exhaust tube 28 (refer to FIG. 4) may be generally installed to face toward the upper surface 21, and a connecting adaptor 30 may be assembled to the upper surface 21 of the case 20. The connecting adaptor 30 may include an inner adaptor 31 connected with the exhaust tube 28 to release exhaust gas, an outer adaptor 32 connected with the air supply tube 27 to supply air, and an air supply adaptor 33 for introduction of air into the outer adaptor 32. The connecting adaptor 30 may be assembled so as to be detachable from the upper surface 21.

As illustrated in FIGS. 1 and 2, the outdoor water-heating device 1 may be manufactured to be suitable only for outdoor use, and the indoor water-heating device may be manufactured to be suitable only for indoor use. Specifically, in a case where the outdoor water-heating device 1 is installed indoors, it may not be easy to supply air and release exhaust gas, and in a case where the indoor water-heating device is installed outdoors, the indoor water-heating device is more likely to malfunction due to foreign matter introduced through the connecting adaptor 30 installed on the upper surface 21, the air supply tube 27, or the exhaust tube 28 (refer to FIG. 4). However, when water-heating devices are separately manufactured for indoor use and outdoor use, it may be inefficient in terms of production and inventory management.

The present disclosure relates to a cap for allowing an indoor water-heating device as illustrated in FIG. 2 to be converted for outdoor use, and a water-heating device including the cap. Specifically, the indoor water-heating device may be converted into an outdoor water-heating device by separating the connecting adaptor 30 included in the indoor water-heating device from the case 20 and coupling a cap 100 according to the present disclosure to the case 20. Hereinafter, a water-heating device 10 and the cap 100 according to the present disclosure will be described in detail with reference to FIGS. 3 to 7.

Figure 3:
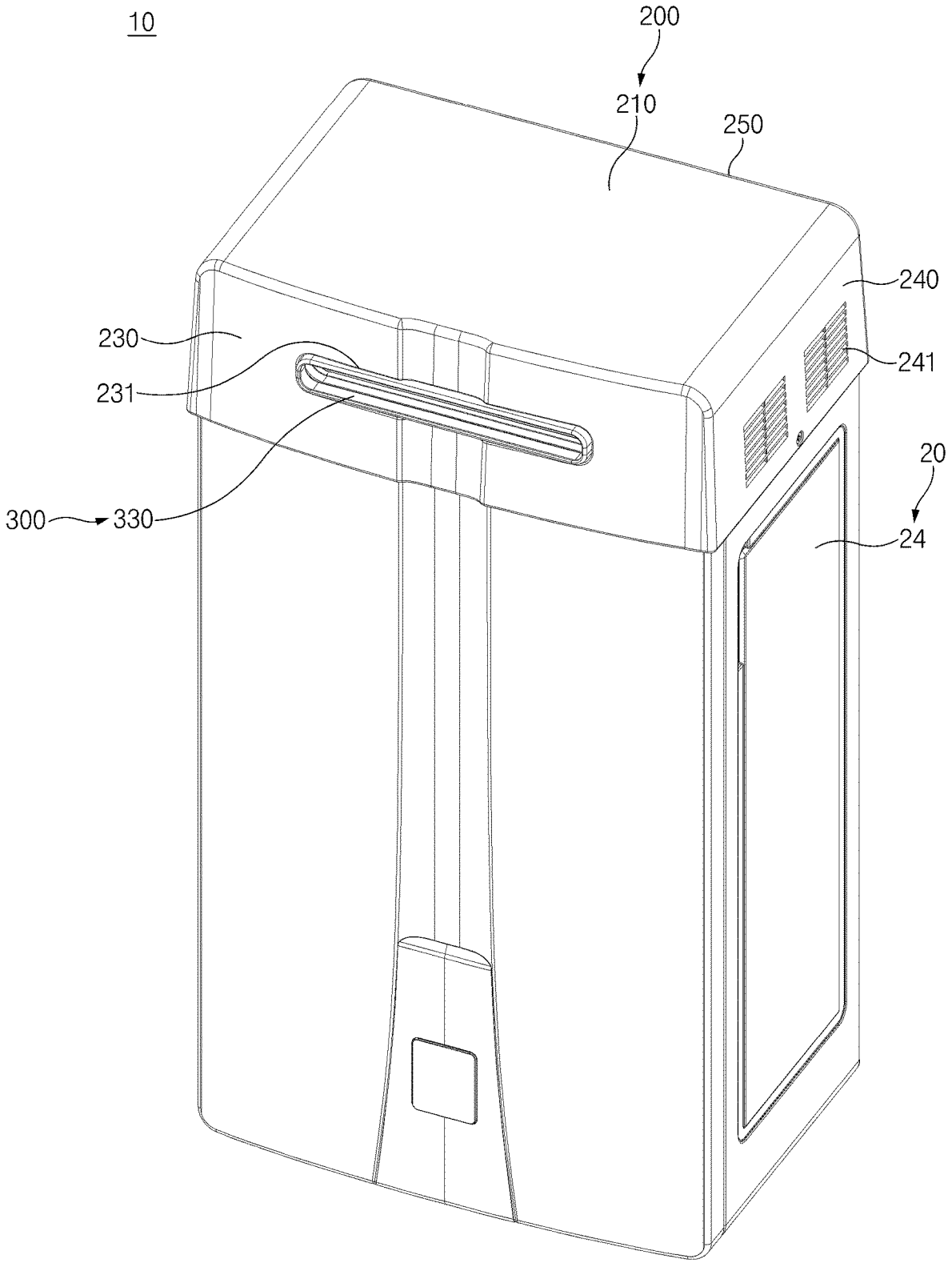
FIG. 3 is a perspective view illustrating a water-heating device having a cap applied thereto according to the present disclosure.
Figure 4:
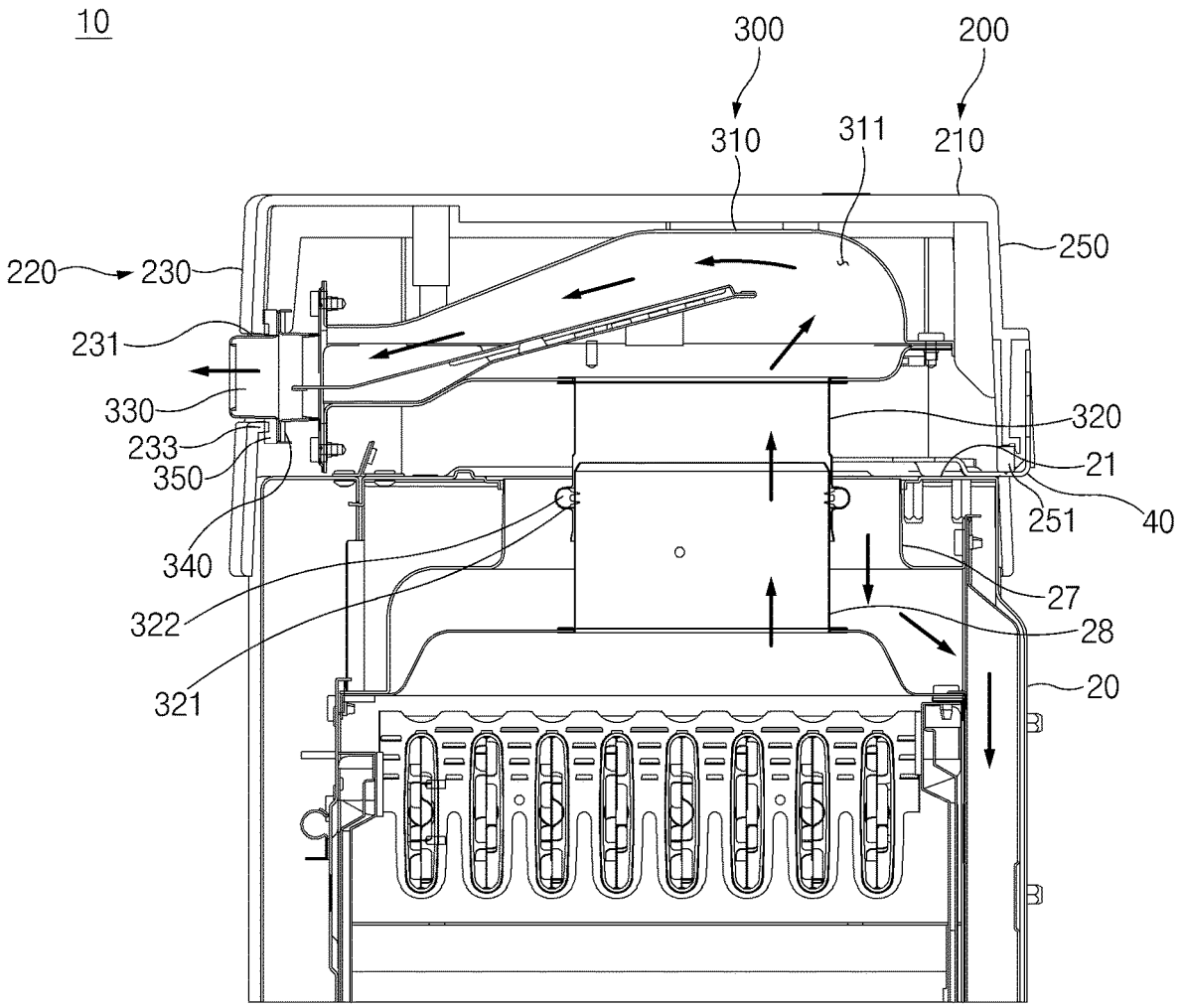
FIG. 4 is a sectional view illustrating the water-heating device of FIG. 3.

Referring to FIGS. 3 and 4, the water-heating device 10 according to the present disclosure may include a case 20 and the cap 100.

The case 20 has an interior space therein. The case 20 includes an air supply tube 27 for introduction of air into the interior space and an exhaust tube 28 for release of exhaust gas generated in the interior space of the case 20. The case 20 may include the upper surface 21 that faces upward and the side surface 24 that is perpendicular to the upper surface 21. The case 20 may have the interior space surrounded by the upper surface 21 and the side surface 24. The case 20 according to the present disclosure may have a form in which the connecting adaptor 30 is separated from the indoor water-heating device 10 illustrated in FIG. 2.

The cap 100 covers the top side of the case 20. The cap 100 includes a cover 200 and an exhaust duct 300.

The cover 200 has an exhaust hole 231 for releasing the exhaust gas in the interior space to the outside. In addition, the cover 200 may further include an air supply hole 241 for introduction of air into the interior space.

The exhaust duct 300 is received in a receiving space and coupled to the cover 200 and forms an exhaust channel 311 that connects the exhaust tube 28 included in the case 20 and the exhaust hole 231 and releases the exhaust gas. The exhaust duct 300 is formed of a material different from the material of the cover 200, and the material of the exhaust duct 300 has higher heat resistance than the material of the cover 200.

The above-configured cap 100 may be coupled with the case 20 to cover the top side of the case 20, thereby allowing the indoor water-heating device 10 to be installed and used outdoors.

Meanwhile, a plurality of heat dissipation holes 22 for dissipating heat generated in the interior space may be formed through the upper surface 21 of the case 20. The upper surface 21 of the case 20 may have a step 23 formed around the plurality of heat dissipation holes 22 such that the region of the upper surface 21 where the heat dissipation holes 22 are formed is in a higher position than the other region of the upper surface 21. The step 23 may prevent foreign matter such as rainwater from being introduced into the heat dissipation holes 22.

The cover 200 may further include a screen 243. The screen 243 may be spaced apart from an inner surface of a sidewall part 220 having the air supply hole 241 formed therein and may be located between the air supply hole 241 and the heat dissipation holes 22. The screen 243 may minimize introduction of foreign matter, which is introduced through the air supply hole 241, into the heat dissipation holes 22.

Hereinafter, the cap 100 according to the present disclosure will be described with reference to FIGS. 3 to 7. Referring to FIGS. 3 to 7, the cap 100 of the water-heating device 10 according to an embodiment of the present disclosure includes the cover 200 and the exhaust duct 300.

The cover 200 has the receiving space that is open at the bottom. The cover 200 has the air supply hole 241 and the exhaust hole 231 formed therein. Air is introduced into the case 20 through the air supply hole 241, and the exhaust gas in the case 20 is released to the outside through the exhaust hole 231.

Specifically, the cover 200 includes an upper plate part 210 spaced apart from the upper surface 21 of the case 20 and the sidewall part 220 extending from the periphery of the upper plate part 210 toward the case 20 to form the receiving space together with the upper plate part 210. That is, the sidewall part 220 may be coupled to the upper plate part 210 at a right angle thereto.

The sidewall part 220 may include a first sidewall 230 having the exhaust hole 231 formed therein and second sidewalls 240 having the air supply hole 241 formed therein. In addition, the sidewall part 220 may further include a third sidewall 250. The first sidewall 230 may be provided on the front side of the upper plate part 210. The third sidewall 250 may be disposed to face the first sidewall 230 with the receiving space therebetween. The second sidewalls 240 may be paired with each other and may connect opposite end portions of the first sidewall 230 and opposite end portions of the third sidewall 250. The receiving space may be defined by the upper plate part 210, the first sidewall 230, the second sidewalls 240, and the third sidewall 250. The air supply hole 241 and the exhaust hole 231 are formed in the sidewall part 220 rather than the upper plate part 210, thereby minimizing introduction of external water or foreign matter through the air supply hole 241 and the exhaust hole 231.

High-temperature exhaust gas generated in a combustion chamber provided in the case 20 may be released through the exhaust channel 311 of the exhaust duct 300. External air may be introduced through the air supply hole 241 formed in the cover 200 and may be introduced into the air supply tube 27 provided in the case 20. Accordingly, the exhaust gas passing through the exhaust channel 311 of the exhaust duct 300 may have a higher temperature than the air introduced through the air supply hole 241 of the cover 200. In particular, in a case where the water-heating device 10 is of a non-condensing type in which latent heat of condensation of combustion gas generated in a burner is not recovered and used, the temperature of the exhaust gas released from the case 20 may be high.

Accordingly, the exhaust duct 300 according to the present disclosure is formed of a material different from the material of the cover 200, and the material of the exhaust duct 300 has higher heat resistance than the material of the cover 200.

That is, the cover 200 and the exhaust duct 300 may be formed of different types of materials. For example, the cover 200 may be formed of a material (e.g., plastic) similar to the material of the case 20 or various materials. The exhaust duct 300 may be formed of a metallic material (e.g., stainless steel) that has higher heat resistance than the material of the cover 200.

By using the cap 100 of the water-heating device 10 according to the present disclosure, an indoor water-heating device as illustrated in FIG. 2 may be converted into an outdoor water-heating device as illustrated in FIG. 3. That is, one product may be installed both indoors and outdoors. Accordingly, the water-heating device 10 may be converted for indoor or outdoor use depending on an installation environment or a country in which the water-heating device 10 is installed, and thus inventory management may be easy.

Furthermore, as the exhaust duct 300 is formed of a metallic material having high heat resistance, the cap 100 may be prevented from being damaged by the high-temperature exhaust gas. In addition, as the cover 200 is formed of a material similar to that of the case 20, the water-heating device 10 may have an appealing appearance even when installed outdoors.

Figure 5:
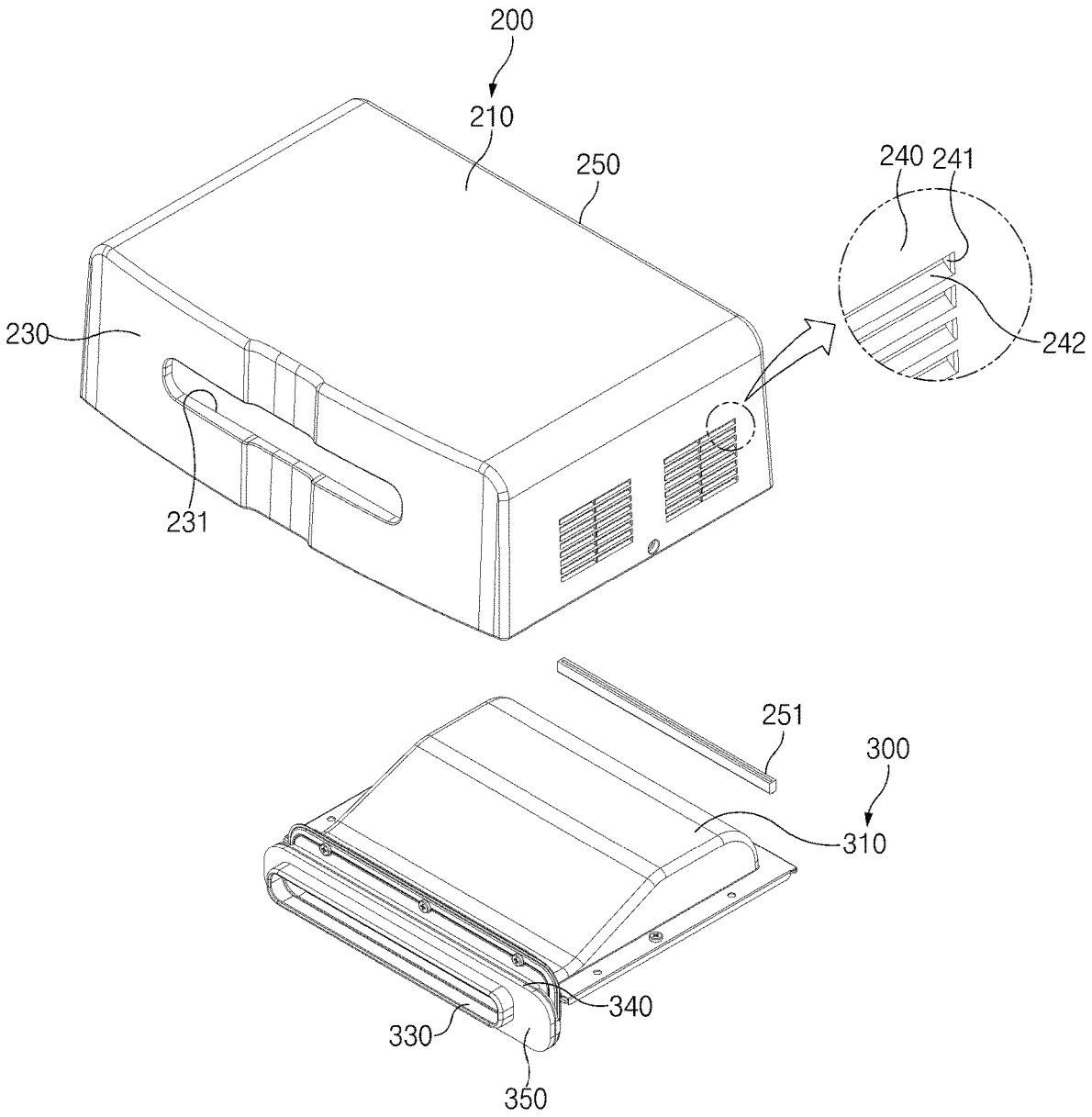
FIG. 5 is an exploded perspective view illustrating the cap according to the present disclosure.
Figure 7:
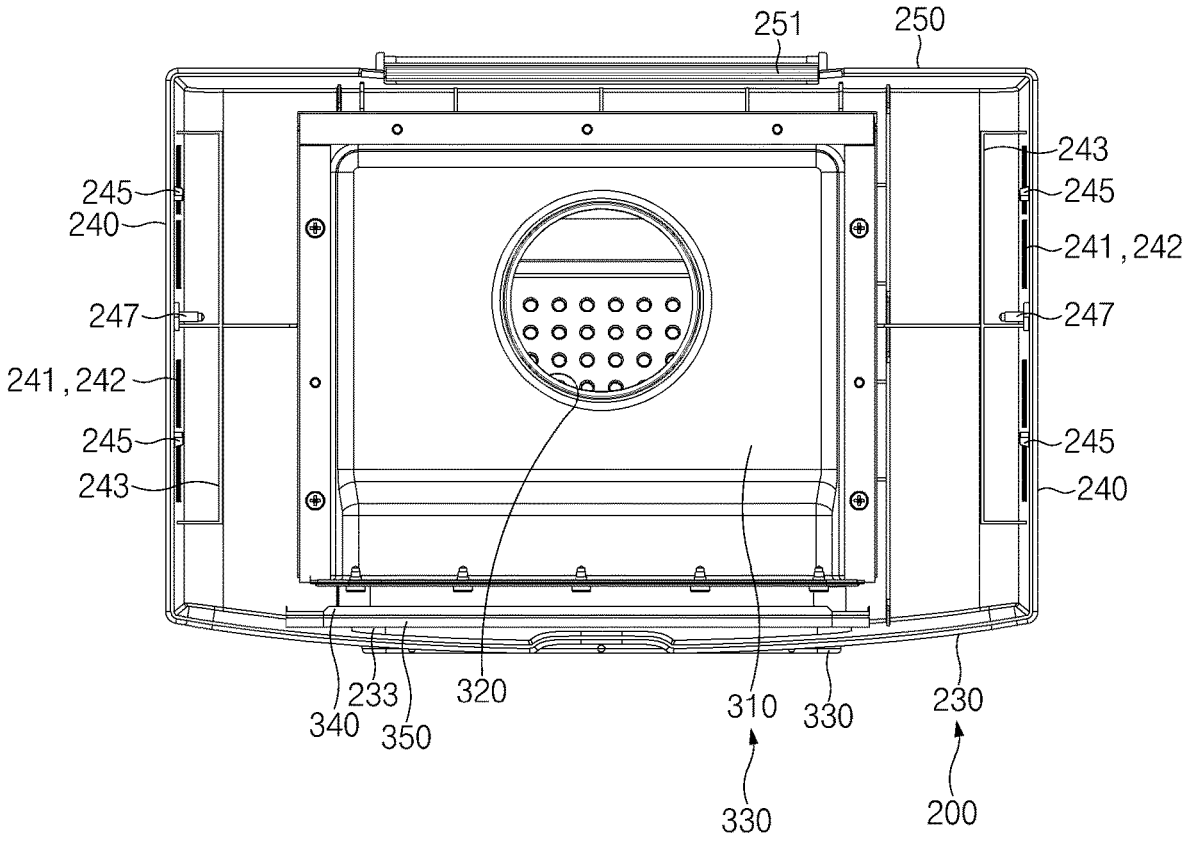
FIG. 7 is a bottom view illustrating the cap according to the present disclosure.

Referring to FIGS. 5 and 7, the air supply hole 241 may include a plurality of air supply holes 241, each of which includes an inclined piece 242. To minimize introduction of water into the receiving space, the inclined piece 242 may be formed to be upwardly inclined toward the receiving space.

Specifically, the air supply holes 241 may be formed through the sidewall part 220. The air supply holes 241 may include the inclined pieces 242, respectively, to prevent introduction of foreign matter such as rainwater into the receiving space through the air supply holes 241. Accordingly, introduction of foreign matter into the case 20 may be firstly prevented.

Figure 6:
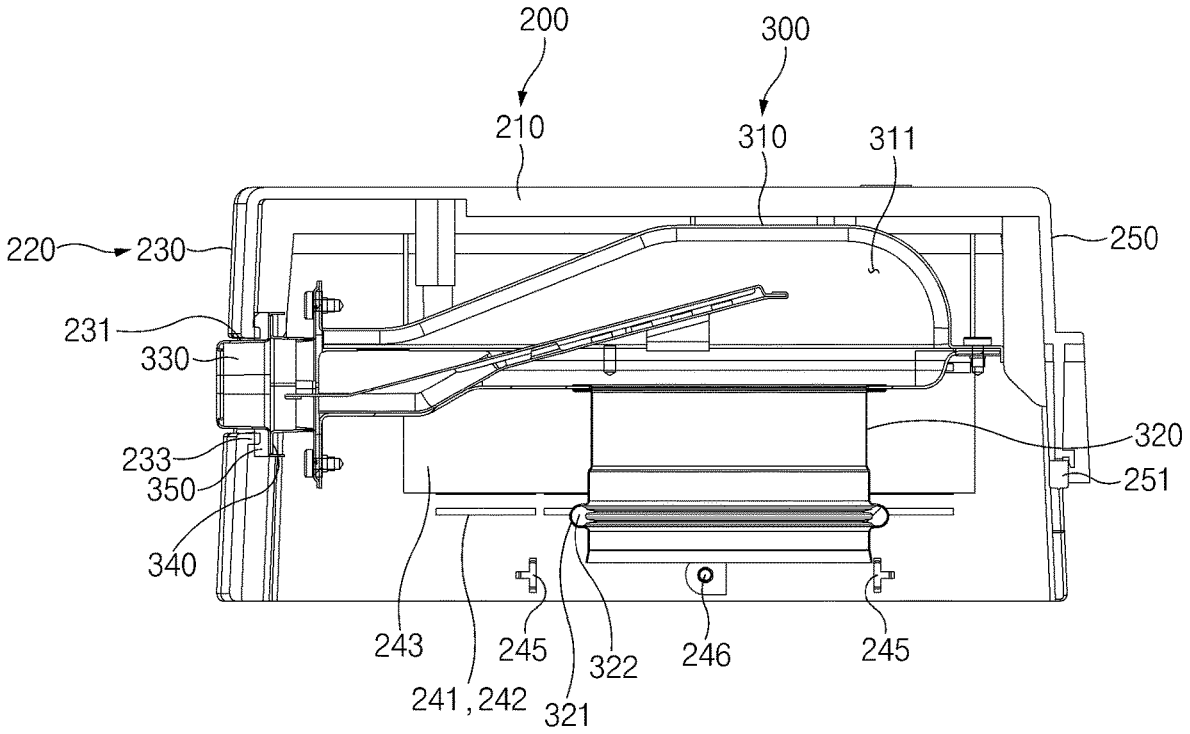
FIG. 6 is a sectional view illustrating the cap according to the present disclosure.

Referring to FIGS. 6 and 7, the cover 200 may further include the screen 243. The screen 243 may be provided on inner surfaces of the second sidewalls 240. The screen 243 may be formed to correspond to the region where the air supply holes 241 are formed. The screen 243 may be spaced apart from the air supply holes 241. The screen 243 may minimize introduction of water into the receiving space through the air supply holes 241.

Specifically, the screen 243 may be coupled to the inner surfaces of the second sidewalls 240 and may be spaced apart from the air supply holes 241. Accordingly, the screen 243 may interrupt introduction of foreign matter other than air without hampering introduction of air into the receiving space through the air supply holes 241. For example, the screen 243 may have a shape in which a horizontal cross-section is formed in the shape of "c" or "U" and opposite end portions are fixed to the inner surfaces of the second sidewalls 240 (refer to FIG. 7). However, the shape of the screen 243 is not limited thereto.

In the case of using the cap 100 according to the present disclosure, even when the water-heating device 10 is installed outdoors, foreign matter other than air that is introduced through the air supply holes 241 may be firstly interrupted by the inclined pieces 242 of the air supply holes 241 and may be secondly interrupted by the screen 243. Further, introduction of the foreign matter into the heat dissipation holes 22 may be thirdly interrupted by the step 23 of the upper surface 21 of the case 20.

The sidewall part 220 may further include protruding inserts 245. The protruding inserts 245 may protrude toward the receiving space so as to be inserted into insertion recesses 25 formed on the side surface 24 of the case 20.

Specifically, the protruding inserts 245 may be provided on sidewalls facing each other among the first sidewall 230, the third sidewall 250, and the pair of second sidewalls 240 of the sidewall part 220, or may be provided on all of the sidewalls. For example, as in the illustrated embodiment, the protruding inserts 245 may protrude from the inner surfaces of the pair of second sidewalls 240 facing each other. The case 20 may have the insertion recesses 25 formed in positions corresponding to the protruding inserts 245. When the cover 200 is coupled to the case 20, a connecting tube 320 of the exhaust duct 300 may be mounted on the exhaust tube 28 provided in the case 20, and accordingly the cap 100 and the case 20 may be firstly coupled together. Furthermore, as the protruding inserts 245 are inserted into the insertion recesses 25, the cap 100 and the case 20 may be secondly coupled together. Thus, the cap 100 may be stably coupled to the case 20.

Referring to FIGS. 2, 5, and 7, the case 20 may have a fastening recess 26 formed on the side surface 24 thereof, and the sidewall part 220 may have a fastening hole 246 formed in a position corresponding to the fastening recess 26. A fastening screw 247 may be coupled to the fastening recess 26 and the fastening hole 246 to more firmly couple the cap 100 and the case 20. For example, a pop nut may be inserted into the fastening recess 26 of the case 20 in advance, and the fastening screw 247 may pass through the fastening hole 246 and may be threaded into the pop nut. Accordingly, in a case where the water-heating device 10 is installed outdoors, introduction of water into the case 20 through the portion to which the fastening screw 247 is fastened may be prevented, and corrosion of the portion to which the fastening screw 247 is fastened may be minimized.

Referring to FIGS. 2, 4, and 5, a fixing bracket 40 for fixing the case 20 to a structure may be provided on the upper surface 21 of the case 20. Furthermore, the cover 200 may include a second packing member 251 for forming a seal between the fixing bracket 40 and the sidewall part 220. The second packing member 251 may be coupled to a lower end portion of the third sidewall 250, which is included in the sidewall part 220 and brought into contact with the fixing bracket 40, and may be brought into close contact with the fixing bracket 40. Here, the second packing member 251 may be formed of a rubber material, but is not limited thereto.

Specifically, the fixing bracket 40 may be implemented with a bracket having the shape of "L" so as to be coupled to the upper surface 21 of the case 20 and an external wall. The third sidewall 250 may include a cut-away portion on a portion thereof that corresponds to the fixing bracket 40 when the third sidewall 250 is coupled with the case 20. The second packing member 251 may be coupled to part of the cut-away portion that makes contact with the fixing bracket 40. The second packing member 251 may prevent water flowing through the wall from being introduced into the receiving space of the cover 200.

Referring to FIGS. 4 to 7, the exhaust duct 300 may include the connecting tube 320, a discharge tube 330, and an exhaust housing 310.

The connecting tube 320 may be mounted on and coupled to the exhaust tube 28. The discharge tube 330 may be provided to release the exhaust gas introduced through the connecting tube 320 and may be inserted into the exhaust hole 231. The exhaust housing 310 may form the exhaust channel 311 through which the exhaust gas introduced into the connecting tube 320 is released to the discharge tube 330.

As the connecting tube 320 is forcibly mounted on the exhaust tube 28 and the discharge tube 330 is press-fit into the exhaust hole 231, the exhaust gas released from the exhaust tube 28 may be released through only the exhaust channel 311 of the exhaust duct 300. That is, the exhaust gas may not be allowed to be introduced into a space between the exhaust housing 310 and an inner surface of the cover 200. Due to this, the high-temperature exhaust gas may be released through the exhaust duct 300 formed of a material having high heat resistance, and thus damage to the cover 200 by heat may be minimized.

The exhaust duct 300 may further include a first packing member 350. The first packing member 350 may be mounted on an outer circumferential surface of the discharge tube 330 to form a seal between the exhaust hole 231 and the discharge tube 330 and may be brought into close contact with an inner surface of the first sidewall 230. The first packing member 350 may prevent foreign matter from being introduced between the exhaust hole 231 and the discharge tube 330.

To increase the sealing force of the first packing member 350, the exhaust duct 300 may further include a pressure flange 340, and the first sidewall 230 may include a pressure protrusion 233.

The pressure flange 340 may be circumferentially formed along the outer circumferential surface of the discharge tube 330 and may be provided on the opposite side to the first sidewall 230 with respect to the first packing member 350. The pressure protrusion 233 may protrude from the inner surface of the first sidewall 230 toward the receiving space and may be formed along the periphery of the exhaust hole 231. The pressure protrusion 233 may be formed in a shape corresponding to the pressure flange 340 so as to be brought into close contact with the first packing member 250.

Specifically, the first sidewall 230, which is coupled with the front side of the case 20, may be formed in various shapes depending on the shape of the case 20. For example, the first sidewall 230 may be formed in a curved shape that is curved toward the front side. In this case, the first packing member 350 may not be brought into close contact with the first sidewall 230. Accordingly, in the present disclosure, the pressure protrusion 233 formed in a shape corresponding to the pressure flange 340 may be formed on the inner surface of the first sidewall 230 and may be brought into close contact with the first packing member 350. The sealing force between the exhaust hole 231 and the outer circumferential surface of the discharge tube 330 may be improved by the pressure protrusion 233 and the pressure flange 340.

The connecting tube 320 may be mounted on an outer circumferential surface of the exhaust tube 28. Furthermore, the connecting tube 320 may have a sealing member insertion portion 321 into which a sealing member 322 for forming a seal between the exhaust tube 28 and the connecting tube 320 is inserted. The sealing member 322 may prevent the exhaust gas from being introduced between the exhaust duct 300 and the inner surface of the cover 200, by forming a seal between the exhaust tube 28 and the connecting tube 320.

By using the cap 100 of the water-heating device 10 according to the present disclosure, an indoor water-heating device as illustrated in FIG. 2 may be converted into an outdoor water-heating device as illustrated in FIG. 3. That is, one product may be installed both indoors and outdoors. Accordingly, the water-heating device 10 may be converted for indoor or outdoor use depending on an installation environment or a country in which the water-heating device 10 is installed, and thus inventory management may be easy.

Furthermore, as the exhaust duct 300 is formed of a metallic material having high heat resistance, the cap 100 may be prevented from being damaged by the high-temperature exhaust gas. In addition, as the cover 200 is formed of a material similar to that of the case 20, the water-heating device 10 may have an appealing appearance even when installed outdoors.

As described above, by using the cap and the water-heating device including the same according to the present disclosure, an indoor water-heating device may be converted so as to be installed and used outdoors. That is, one product may be installed both indoors and outdoors. Accordingly, the water-heating device may be converted for indoor or outdoor use depending on an installation environment or a country in which the water-heating device is installed, and thus inventory management may be easy.

Furthermore, as the exhaust duct is formed of a metallic material having high heat resistance, the cap may be prevented from being damaged by high-temperature exhaust gas. In addition, as the cover is formed of a material similar to that of the case, the water-heating device may have an appealing appearance even when installed outdoors.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A cap for covering a top side of a case of a water-heating device, the cap comprising:

a cover having a receiving space that is open at the bottom, the cover including an exhaust hole formed therein for releasing exhaust gas in the case to the outside; and an exhaust duct received in the receiving space and coupled to the cover, wherein the exhaust duct forms an exhaust channel configured to connect an exhaust tube included in the case and the exhaust hole and release the exhaust gas, wherein the exhaust duct is formed of a material different from a material of the cover, and the material of the exhaust duct has higher heat resistance than the material of the cover, wherein the exhaust duct includes:

a connecting tube coupled to the exhaust tube;

a discharge tube inserted into the exhaust hole and configured to release the exhaust gas introduced through the connecting tube; and an exhaust housing connected to the connecting tube and the discharge tube.

2. The cap of claim 1, wherein the cover further includes an air supply hole configured to introduce air into the case.

3. The cap of claim 2, wherein the cover includes an upper plate part spaced apart from an upper surface of the case and a sidewall part extending from a periphery of the upper plate part toward the case to form the receiving space together with the upper plate part, and wherein the sidewall part includes a first sidewall in which the exhaust hole is formed and a second sidewall in which the air supply hole is formed.

4. The cap of claim 3, wherein the air supply hole includes a plurality of air supply holes, each of which includes an inclined piece formed to be upwardly inclined toward the receiving space so as to minimize introduction of water into the receiving space.

5. The cap of claim 3, wherein the cover further includes a screen provided on an inner surface of the second sidewall to minimize introduction of water into the receiving space through the air supply hole, wherein the screen is formed to correspond to a region having the air supply hole formed therein and is spaced apart from the air supply hole.

6. A cap for covering a top side of a case of a water-heating device, the cap comprising:

a cover having a receiving space that is open at the bottom, the cover including an exhaust hole formed therein for releasing exhaust gas in the case to the outside; and an exhaust duct received in the receiving space and coupled to the cover, wherein the exhaust duct forms an exhaust channel configured to connect an exhaust tube included in the case and the exhaust hole and release the exhaust gas, wherein the exhaust duct is formed of a material different from a material of the cover, and the material of the exhaust duct has higher heat resistance than the material of the cover, wherein the cover includes an upper plate part spaced apart from an upper surface of the case and a sidewall part extending from a periphery of the upper plate part toward the case to form the receiving space together with the upper plate part, and wherein the sidewall part includes a protruding insert protruding toward the receiving space so as to be inserted into an insertion recess formed on a side surface of the case.

7. The cap of claim 1, wherein the exhaust duct further includes a first packing member mounted on an outer circumferential surface of the discharge tube to form a seal between the exhaust hole and the discharge tube, the first packing member being brought into close contact with an inner surface of the first sidewall.

8. The cap of claim 7, wherein the exhaust duct further includes a pressure flange circumferentially formed along the outer circumferential surface of the discharge tube and provided on the opposite side to the first sidewall with respect to the first packing member, and wherein the first sidewall includes a pressure protrusion protruding from the inner surface of the first sidewall toward the receiving space, the pressure protrusion being formed along a periphery of the exhaust hole, wherein the pressure protrusion is formed in a shape corresponding to the pressure flange so as to be brought into close contact with the first packing member.

9. The cap of claim 1, wherein a fixing bracket configured to fix the case to a structure is provided on the upper surface of the case, and wherein the cover further includes a second packing member provided on the sidewall part to form a seal between the fixing bracket and the sidewall part and coupled to a lower end portion of a third sidewall configured to make contact with the fixing bracket, the second packing member being brought into close contact with the fixing bracket.

10. The cap of claim 7, wherein the connecting tube is mounted on an outer circumferential surface of the exhaust tube and has a sealing member insertion portion into which a sealing member configured to form a seal between the exhaust tube and the connecting tube is inserted.

11. A water-heating device comprising:

a case having an interior space therein, the case including an air supply tube configured to introduce air into the interior space and an exhaust tube configured to release exhaust gas generated in the interior space; and a cap configured to cover a top side of the case, wherein the cap includes:

a cover having a receiving space that is open at the bottom, the cover including an exhaust hole formed therein for releasing the exhaust gas in the interior space to the outside; and an exhaust duct received in the receiving space and coupled to the cover, wherein the exhaust duct forms an exhaust channel configured to connect an exhaust tube included in the case and the exhaust hole and release the exhaust gas, and wherein the exhaust duct is formed of a material different from a material of the cover, and the material of the exhaust duct has higher heat resistance than the material of the cover, wherein a plurality of heat dissipation holes configured to dissipate heat generated in the interior space are formed through an upper surface of the case, and wherein the upper surface of the case has a step formed around the plurality of heat dissipation holes such that a region of the upper surface where the heat dissipation holes are formed is in a higher position than the other region of the upper surface, and wherein the cover further includes:

an air supply hole configured to introduce air into the interior space; and a screen spaced apart from an inner surface of a sidewall part having the air supply hole formed therein, the screen being located between the air supply hole and the heat dissipation holes to minimize introduction of foreign matter into the heat dissipation holes, wherein the foreign matter is introduced through the air supply hole.

* * * * *